United States Patent [19]

Benke

[11] 4,129,845

[45] Dec. 12, 1978

[54] VAPORIZATION COOLED ELECTRICAL APPARATUS

[75] Inventor: Frank W. Benke, Hermitage, Pa.

[73] Assignee: Electric Power Research Institute, Inc., Palo Alto, Calif.

[21] Appl. No.: 816,129

[22] Filed: Jul. 15, 1977

[51] Int. Cl.[2] ..... H01F 27/10

[52] U.S. Cl. ..... 336/57; 174/15 R; 336/58; 336/60

[58] Field of Search ..... 336/55, 57, 58, 60, 336/197; 174/15 R; 239/565, DIG. 1

[56] References Cited

U.S. PATENT DOCUMENTS

| | | | |
|---|---|---|---|
| 648,263 | 4/1900 | Hull | 239/565 X |
| 2,734,096 | 2/1956 | Ennis | 336/55 X |
| 2,771,320 | 11/1956 | Korwin | 239/565 X |
| 2,944,388 | 7/1960 | Bayer | 239/DIG. 1 |
| 3,028,566 | 4/1962 | Camilli | 336/60 X |
| 3,201,727 | 8/1965 | Narbut et al. | 336/58 X |
| 3,261,905 | 7/1966 | Allen | 336/58 X |
| 3,300,388 | 1/1967 | Jerman et al. | 239/DIG. 1 |
| 3,369,754 | 2/1968 | Wolford | 239/DIG. 1 |
| 4,048,603 | 9/1977 | Staub et al. | 336/60 X |

FOREIGN PATENT DOCUMENTS

| | | | |
|---|---|---|---|
| 752095 | 7/1956 | United Kingdom | 336/58 |

*Primary Examiner*—Thomas J. Kozma
*Attorney, Agent, or Firm*—D. R. Lackey

[57] ABSTRACT

A fluid distribution manifold for a vaporization cooled electrical apparatus. The manifold includes a flexible conduit of predetermined shape having a plurality of longitudinal and circumferential spaced apertures therein which distribute a vaporizable dielectric fluid uniformly and economically over the electrical apparatus.

5 Claims, 2 Drawing Figures

VAPORIZATION COOLED ELECTRICAL APPARATUS

BACKGROUND OF THE INVENTION

1. Field of the Invention

This invention relates, in general, to electrical inductive apparatus and, more specifically, to vaporization cooled electrical inductive apparatus.

2. Description of the Prior Art

Vaporization cooling systems have been proposed for electrical inductive apparatus, such as transformers, reactors and the like, utilizing a two-phase dielectric fluid which has a boiling point within the normal operating temperature range of the electrical inductive apparatus. The dielectric fluid is applied to the electrical inductive apparatus in its liquid state, whereon it evaporates as it contacts the heat producing members and removes heat in quantities equal to the latent heat of vaporization of the dielectric fluid. The resulting vapors are then condensed and reapplied to the heat producing elements in a continuous cycle. In a typical vaporization cooling system for a transformer, the windings contain a plurality of vertically extending ducts. The dielectric fluid must be distributed uniformly over the vertical ducts to insure even cooling of the windings and thus prevent the formation of hot spots within the transformer. Typical methods of applying the dielectric fluid in uniform quantities through the ducts include the use of spray devices or headers having a plurality of apertures therein which are disposed above the transformer, as shown in U.S. Pat. Nos. 2,561,738 and 2,875,263, and also the use of perforated plates or pans disposed above the transformer as shown in U.S. Pat. Nos. 3,024,298, 3,887,759 and 4,011,535.

In operation, transformers encounter frequent and severe short circuits which generate horizontal and vertical forces on the windings on the order of several hundred thousand pounds. The horizontal forces, which cause the low voltage coil to compress against the core and the high voltage coil to be stressed in tension, are restrained by the use of end frames and lock plates which rigidly brace the coils against the core. The vertical forces, which are caused by radial flux components and the axial displacement of the electrical centerlines of the windings, are restrained by the use of pressure rings which are typically circular plates disposed above the windings and interlocked to the end frames to distribute the vertical forces uniformly from the coils to the end frames to prevent any vertical displacement of the windings.

The use of pressure rings effectively blocks off the ends of the ducts extending through the windings since the pressure ring must be disposed immediately adjacent with the windings to prevent any vertical displacement thereof. In certain electrical inductive apparatus, which utilize oil as the dielectric coolant fluid, baffles or ducts are provided around the pressure ring to provide a fluid flow path for the oil through the windings of the transformer. Such a construction cannot be used in vaporization cooled apparatus since the vaporizable fluid flows through the ducts and the windings from top to bottom which is directly opposite that of an oil-cooled transformer wherein the oil coolant is forced through the ducts and the windings from the bottom to the top of the transformer. Furthermore, the use of baffles around the pressure ring does not provide the uniform distribution of the vaporizable fluid across the surface of the windings which is essential in preventing hot spots from developing in the windings of the transformer.

In multi-phase transformers, a core yoke is used to connect the cores in each phase. In such constructions, the portion of the windings disposed beneath the core yoke are blocked from the direct flow of the dielectric fluid such that a temperature gradient is formed in the windings.

The liquid distribution systems utilized in prior art vaporization cooled electrical inductive apparatus do not provide a uniform distribution of the dielectric fluid to the portion of the windings located beneath the pressure rings or the core yoke since such liquid distribution systems utilize spray devices located above the electrical apparatus.

Thus, it would be desirable to provide an improved fluid distribution system for a vaporization cooled electrical inductive apparatus that uniformly distributes the dielectric fluid over the entire surface of the windings. Further, it would be desirable to provide a fluid distribution system that enables the dielectric fluid to be applied beneath the pressure rings and beneath the core yoke of the electrical inductive apparatus.

SUMMARY OF THE INVENTION

Herein disclosed is a novel fluid distribution manifold for a vaporization cooled electrical inductive apparatus. A flexible conduit, constructed of electrical insulating material and having a plurality of longitudinal and circumferential apertures therein, is disposed adjacent the upper end of the windings of the electrical inductive apparatus. The conduit is formed in a predetermined pattern which uniformly and economically distributes the dielectric fluid to ducts disposed within the windings of the apparatus. A pump, situated in the bottom portion of the tank, is disposed in fluid flow communication with the fluid distribution manifold to circulate the vaporizable dielectric fluid through the windings in a continuous cycle.

Disc-shaped insulating members having a plurality of spacers attached thereto are utilized in transformers having pressure rings to resist vertical displacement of the windings during short circuit fault conditions. The disc-shaped members are disposed between the upper pressure ring and the upper end of the winding and between the lower pressure ring and the lower end of the winding to not only maintain the compressive stress on the winding but also to form an opening adjacent each end of the winding. The fluid distribution manifold is disposed within the opening adjacent the upper end of the winding to provide a uniform distribution of the dielectric fluid beneath the pressure ring. The lower opening forms a fluid flow path through the windings for the unevaporated dielectric fluid and the evolved vapors.

The above-described fluid distribution manifold provides a uniform distribution of dielectric fluid over the windings of a transformer since the conduit can be positioned in proximity to the windings without any electrical stress problems. Thus, the conduit can be extended between the core yoke and the winding to provide dielectric fluid to that portion of the winding. Furthermore, by utilizing disc-shaped insulative members and spacers, the conduit can be disposed between the winding and the pressure ring to provide a uniform distribution of dielectric fluid to the winding located beneath the pressure ring assembly.

In addition, the fluid distribution manifold depicted herein economically distributes the costly vaporizable dielectric fluid since the fluid is applied only where it is needed, namely, on the windings. This minimizes the amount of dielectric fluid required to adequately cool the transformer and further reduces the capacity requirements of the pump and the energy usage associated therewith.

BRIEF DESCRIPTION OF THE DRAWING

The various features, advantages and additional uses of this invention will become more apparent by referring to the following detailed description and the accompanying drawing, in which.

DESCRIPTION OF THE PREFERRED EMBODIMENT

Figure 1:
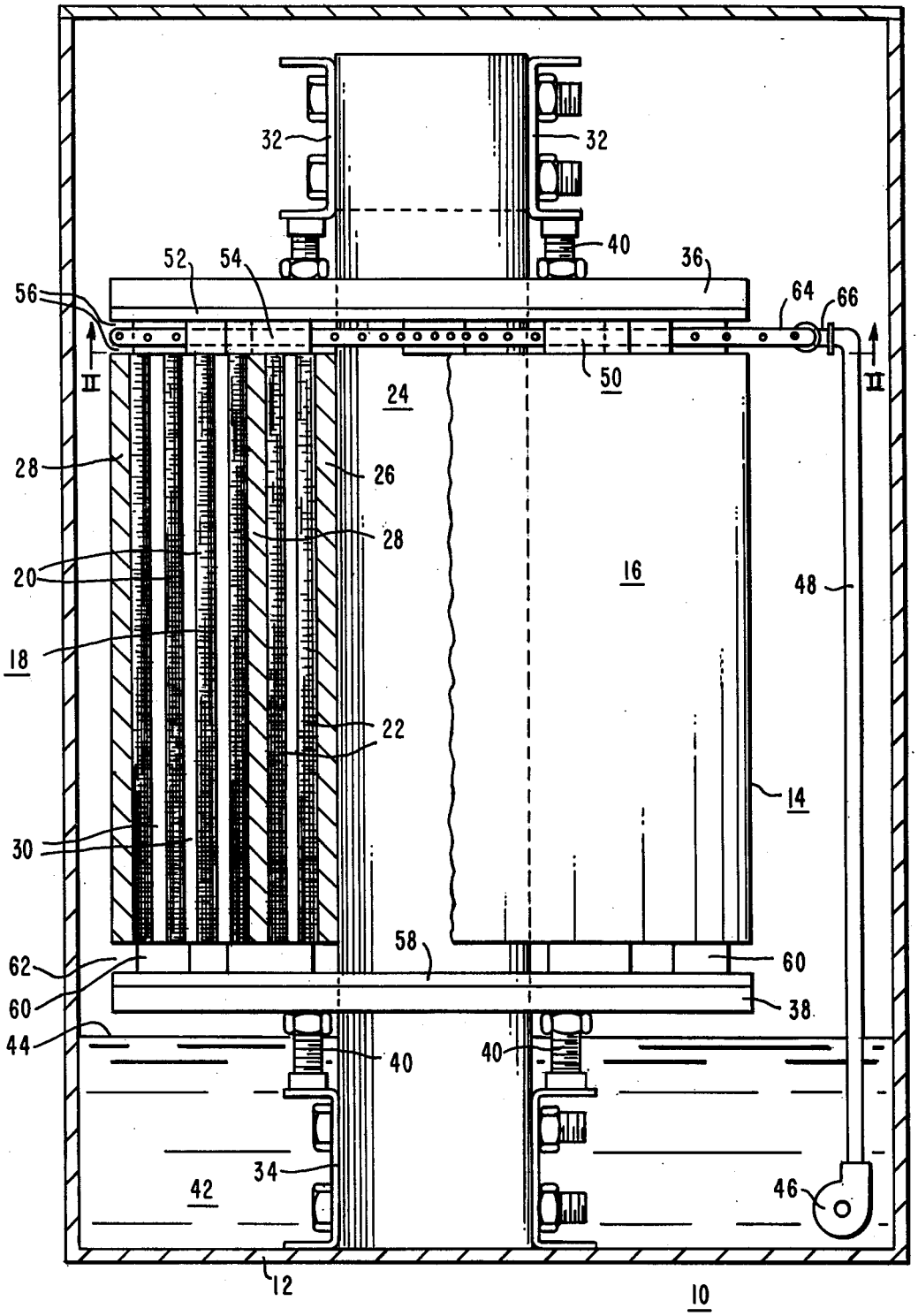
FIG. 1 is an elevational view, partially in section and partially broken away, of an electrical inductive apparatus constructed according to the teachings of this invention.

Referring now to the drawing, and to FIG. 1 in particular, there is shown an electrical inductive apparatus 10 constructed according to the teachings of this invention. The electrical inductive apparatus 10 consists of a sealed enclosure or housing 12 wherein there is disposed a heat producing member 14, such as a transformer, reactor or the like and, hereafter, referred to as a transformer. The transformer 14 consists of a magnetic core and coil assembly 16 wherein phase windings 18 are disposed in inductive relation with a magnetic core 24. For clarity, only one vertical leg of the magnetic core 24 and one phase winding 18 are shown. The phase winding 18 consists of a high voltage conductor 20 and a low voltage conductor 22, each of which forms a plurality of turns around the magnetic core 24. In the preferred embodiment of this invention, the high voltage conductor 20 is wrapped around the low voltage conductor 22; although any other configuration of high and low voltage conductors may be utilized. A winding tube 26, constructed of suitable insulative material, is disposed between the innermost layer of the low voltage conductor 22 and the magnetic core 24 to electrically insulate the low voltage conductor 22 from the grounded core 24. Additional insulative material 28 is shown disposed at the interface of the high and low voltage conductors, 20 and 22, and also around the outermost layer of the high voltage conductor 20 to provide additional insulation for the magnetic core and coil assembly 16. A plurality of vertical cooling ducts 30 are disposed between the turns of the windings 20 and 22. The ducts 30 are formed by suitable means, such as by a plurality of circumferentially and radially disposed spacer members, not shown, or by forming the turns of the windings 20 and 22 so as to define vertical passages therebetween for coolant flow. For clarity, the electric leads and electrical insulating bushings, normally used to connect the high and low voltage conductors 20 and 22 to an external electrical circuit are not shown.

To insure mechanical integrity of the transformer 14, first and second end frames, 32 and 34 respectively, are secured to the magnetic core 24 by suitable fastening means, such as by bolts. It is to be understood that additional support members, not shown, encircle the magnetic core and coil assembly 16 and are joined to the first and second end frames 32 and 34 to provide sufficient strength to resist the severe forces exerted on the magnetic core and coil assembly 16 during short circuit fault conditions. In addition, first and second pressure rings or plates, 36 and 38, respectively, are placed adjacent the upper and lower ends of the phase winding 18. Suitable pressure producing means, such as jack bolts 40, are positioned between the first pressure ring 36 and the first end frame 32 and between the second pressure ring 38 and the second end frame 34 to apply sufficient pressure to both the first and second pressure rings 36 and 38 to resist vertical displacement of the phase winding 18 during short circuit fault conditions.

According to the preferred embodiment of this invention, the transformer 14 is cooled by a dielectric fluid 42 which its boiling point within a normal operating temperature range of the transformer 14. In addition, the dielectric fluid 42 provides electrical insulation between the turns of the phase windings 18 during the operation of the transformer 14. As known to those skilled in the art, fluid dielectrics with such properties generally include the inert fluorinated organic compounds, such as perflurodibutyl ether or perflurocyclic ether. Other examples of compounds that may be used to practice this invention are listed in greater detail in U.S. Pat. No. 2,961,476, issued to Maslin and Narbut.

In operation, a portion of the dielectric fluid 42 will evaporate as it flows through the vertical ducts 30 and transfer heat from the phase winding 18. The vapors, thus evolved, will flow through the vertical ducts 30 into the housing 12 whereon they will subsequently condense and return by gravity to the bottom of the housing 12. Radiators or other suitable cooling means, not shown, may be utilized to provide additional cooling of the evolved vapors of the dielectric fluid 42. In addition, a quantity of an inert non-condensible gas, such as sulfur hexafluoride ($SF_6$) may be disposed within the housing 12 to provide additional electrical insulation for the transformer 14 during initial startup. An additional reservoir or other suitable storage means, not shown, may be provided to store the non-condensible gas when the transformer 14 has reached its normal operating range since the non-condensible gas is not effective as a cooling medium.

The inert fluorocarbons utilized as dielectric fluids in vaporization cooled transformers are quite costly and, thus, economics dictate that the quantity of such fluids be minimized. Furthermore, the dielectric fluid 42 must be distributed uniformly over the surfaces of the phase windings 18 and in a sufficient quantity to prevent any rupture of the liquid film which would create undesirable hot spots within the transformer 14. Accordingly, a quantity of dielectric fluid 42 is disposed within the housing 12 which would fill the bottom of the housing 12, under no load conditions, to approximately the liquid level 44. A suitable supply means, such as a pump 46, is disposed below the level 44 of the dielectric fluid 42. A fluid conductor or conduit 48 disposes the pump 46 in fluid flow communication with the fluid distribution manifold 50 situtated above the windings 20 and 22 of the transformer 14. The fluid distribution manifold 50 uniformly distributes the dielectric fluid 42 to the ducts 30. A portion of the dielectric fluid 42 flowing down through the ducts 30 will evaporate as it transfers heat from the windings 20 and 22. The evolved vapors will flow through the ducts 30 into the housing 12 whereon they will subsequently recondense and flow by gravity to the bottom portion of the housing 12. In addition, the portion of the dielectric fluid 42 that did not evaporate as it flowed through the ducts 30 will flow out the lower ends of the ducts 30 into the bottom portion of the housing 12 and will be recirculated through the pump 46, the conduit 48 and the fluid distribution manifold 50 in a continuous cycle.

As previously mentioned, the dielectric fluid 42 must be uniformly distributed over the surfaces of the windings 20 and 22 to prevent any hot spots from forming in the transformer 14. However, certain transformer constructions, such as those having a circular coil arrangement of strap-type conductors, have hindered the use of vaporization cooling systems since such transformers utilize pressure rings, such as pressure ring 36 shown in FIG. 1, to prevent vertical displacement of the conductors caused by the severe forces existent during short circuit fault conditions. In such a construction, the pressure rings are disposed adjacent the top and bottom ends of the windings and thus effectively block or seal the ends of the ducts contained therein. To overcome this problem, there is herein disclosed a unique fluid distribution manifold 50 which uniformly distributes a vaporizable dielectric fluid beneath the pressure ring of a transformer. Furthermore, the novel fluid distribution manifold described below efficiently distributes the dielectric fluid through the ducts contained within the windings of the transformer and is also simple and inexpensive to construct. It is to be expressly understood that the novel fluid distribution manifold described hereafter is equally applicable to transformers without pressure ring assemblies. In particular, the fluid distribution manifold may be used to provide a uniform distribution of variable dielectric fluid to the portion of the winding that is located beneath the yoke of the core which connects each core in a multi-phase transformer.

Figure 2:
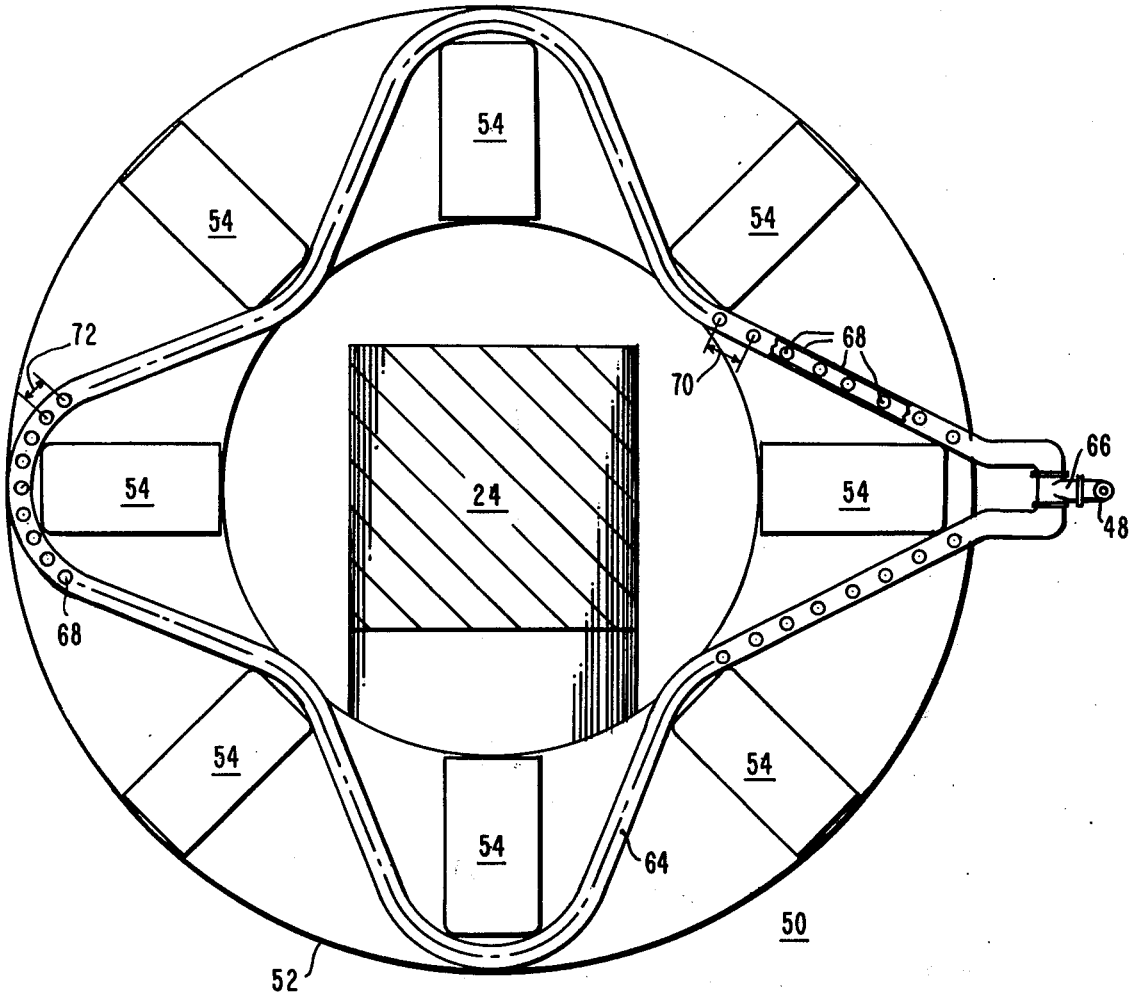
FIG. 2 is a sectional view, generally taken along line II—II in FIG. 1, showing a fluid distribution manifold constructed according to the teachings of this invention.

Accordingly, there is shown in FIG. 2, a fluid distribution manifold 50 constructed according to the preferred embodiment of this invention. The fluid distribution manifold 50 includes a disc-shaped member 52 constructed of suitable electrical insulating material and having substantially the same inner and outer diameter as the pressure ring 36 adjacent which it is disposed. The member 52 provides a mounting surface for a plurality of circumferentially spaced blocks or spacers 54 which are bonded or otherwise secured to the surface of the disc-shaped member 52 opposite the surface that is adjacent the pressure ring 36. As shown in FIG. 1, the disc-shaped member 52 is disposed between the pressure ring 36 and the upper ends of the windings 20 and 22 such that the spacers 54 are in registry with the windings 20 and 22. The spacers 54 and the disc-shaped member 52 interact with the first pressure ring 36, the jack bolts 40 and the first end frame 32 to provide compressive stress on the upper ends of the windings 20 and 22 to prevent vertical displacement of the windings 20 and 22 during short circuit fault conditions. The spacers 54 also define a first passage or space 56 above the windings 20 and 22, the use of which will be described in greater detail below. An identical disc-shaped member 58 and circumferentially spaced blocks or spacers 60 are disposed between the second or lower pressure ring 38 and the lower ends of the windings 20 and 22 to again provide compressive stress on the windings of the transformer 14. In addition, the spacers 60 define a second passage 62 which is utilized as a fluid flow path for the dielectric fluid 42.

Referring again to FIG. 2, there is shown a fluid conductor or conduit 64 whose configuration has been found to efficiently and uniformly distribute the dielectric fluid 42 to the ducts 30 in the circular windings 20 and 22 of the transformer 14. The conduit 64, which can be any suitable tubular member, is disposed in the first passage 56 between the disc-shaped member 52 and the upper portion or ends of the windings 20 and 22 of the transformer 14. Furthermore, conduit 64 is constructed of electrically insulating material, such as one sold commercially under the trade name "Teflon", although other materials, such as copper tubing, may also be utilized if suitable electrical clearances are provided between the conduit 64 and the electrical windings 20 and 22 of the transformer 14. In addition, it has been found that construction of the fluid distribution manifold 50 can be simplified if the conduit 64 is constructed of flexible material, as compared to rigid tubing, which enables it to be easily formed to the desired shape.

By way of example and not of limitation, the first and second ends of the second conduit 64 are disposed in fluid flow communication with the conduit 48 by a fluid coupling 66. Other fluid connections can easily be substituted for that shown in FIG. 2 and could include, for example, the first end of the conduit 64 disposed in fluid communication with the conduit 48; while the second end of the conduit 64 is sealed, or two separate conduits could be substituted for the conduit 64, one end of each being disposed in fluid communication with the conduit 48 and the other end of each being sealed.

In order to distribute the dielectric fluid 42 to the ducts 30 in the windings 20 and 22, a plurality of apertures or small openings 68 are provided along the length of the conduit 64 or, at a minimum, in the portion of the conduit 64 that is adjacent the ends of the windings 20 and 22. According to the preferred embodiment of this invention, the apertures 68 are longitudinally and circumferentially spaced around the outer surface of the conduit 64 to provide a spraying action which distributes the dielectric fluid 42 uniformly to the ducts 30 and thereby prevents the formation of hot spots in the windings 20 and 22. The disc-shaped member 52 deflects a portion of the dielectric fluid from the conduit 64 onto the windings 20 and 22, and thereby increases the spraying action.

A pressure gradient or drop will exit across the length of the conduit 64. To overcome this pressure gradient and thereby provide uniform distribution of the dielectric fluid 42, the spacing between adjoining apertures 68 is varied across the length of the conduit 64. Thus, the spacing between adjoining apertures 68 in the portion of the conduit 64 that is closest to the fluid coupling 66 and the first conduit 48 will be that indicated by reference number 70. In the portion of the conduit 64 that is furthest removed from the source of dielectric fluid 42 to the conductor 64, a smaller spacing between adjoining apertures 68, as indicated by reference number 72, is provided. This has the effect of evening out distribution of dielectric fluid 42 across the entire length of the conduit 64 since additional openings 68 are provided in the portion of the conduit 64 having a lower internal pressure. As an alternative to decreasing the spacing between adjoining apertures 68, the size of the openings 68 could be enlarged to provide additional flow of dielectric fluid 42 and thereby even out the distribution of the fluid 42 across the entire length of the conduit 64.

The shape or form of the conduit 64 shown in FIG. 2 was found to provide efficient and uniform distribution of the dielectric fluid 42 due to the spraying action provided by the circumferentially spaced apertures 68 described above. Accordingly, the spacer members 54, whose length is slightly less than the width of the disc-shaped member 52 are alternatively positioned such that the end of one spacer member 54 is positioned adjacent the outer edge of the disc-shaped member 52 while the adjacent spacer member 54 is positioned such that its end is adjacent the inner edge of the disc-shaped member 52. The conduit 64 is positioned between the edge of the disc-shaped member 52 and the end of the spacer member 54 opposite the end that is adjacent the other edge of the disc-shaped member 52. The conduit 64 is fixedly secured, such as by taping, to the spacer members 54 to maintain it in the desired form. In such a configuration, the conduit 64 passes diagonally back and forth across the upper ends of the ducts 30 in a zig-zag fashion to provide the desired uniform distribution of the dielectric fluid 42 to the ducts 30.

As previously described, an identical disc-shaped member 58 having a plurality of spacer members 60 attached thereto is disposed between the lower ends of the ducts 30 and the second or lower pressure ring 38. The duct 62 that is formed between the disc-shaped member 58 and the lower ends of the ducts 30 provides a fluid flow path for the unevaporated dielectric fluid 42 flowing through the ducts 30 to the bottom portion of the housing 12 whereby it will be recirculated through the pump 46, the conduit 48 and the fluid distribution manifold 50 onto the windings 20 and 22 in a continuous cycle.

It will be apparent to one skilled in the art that there has been herein disclosed a novel fluid distribution manifold that provides a uniform distribution of dielectric fluid to the windings of a vaporization cooled electrical inductive apparatus. The use of a flexible conduit constructed of electrically insulative material enables the conduit to be positioned in registry with the end of the windings which, in conjunction with the spaced apertures in the conduit, provides a uniform distribution of the dielectric fluid across the entire winding thereby eliminating any temperature gradient or hot spots in the windings. In transformer constructions utilizing pressure rings for mechanical strength, the disposition of disc-shaped members having a plurality of spacers attached thereto between the windings and the pressure rings enables the conduit to be disposed beneath the pressure ring and thereby provide a previously difficult to attain uniform distribution of dielectric fluid to the portion of the windings beneath the pressure ring. In addition, such a fluid distribution manifold can be disposed between the windings and the core yoke interconnecting the cores in a multi-phase electrical inductive apparatus to distribute dielectric fluid to the position of the windings beneath the yoke. Besides providing uniform distribution of the dielectric fluid, the novel fluid distribution manifold disclosed herein also provides efficient usage of the dielectric fluid since the fluid is applied or sprayed only where it is needed, namely, into the ducts, thereby minimizing the amount of costly vaporizable dielectric fluid required to adequately cool the electrical apparatus and also reducing the required pump capacity.

What is claimed is:

1. An electrical inductive apparatus comprising:

a sealed housing;

an electrical winding having top and bottom ends disposed in inductive relation with a magnetic core in said sealed housing;

said electrical winding having a plurality of radially spaced cooling ducts extending between said top and bottom ends of said electrical winding;

a dielectric fluid, vaporizable within the normal operating temperature range of said electrical inductive apparatus, disposed within said housing, said dielectric fluid having a liquid level above the bottom of said housing;

means for supplying said dielectric fluid from said bottom portion of said housing to the top portion of said housing;

means for applying compressive stress to said top and bottom ends of the electrical winding, said means including first and second pressure rings, with said first pressure ring disposed around the magnetic core and adjacent said top end of said electrical winding and said second pressure ring disposed around said magnetic core and adjacent said bottom end of said electrical winding, and means for applying pressure to said first and second pressure rings to hold said electrical winding in compression; and means for distributing said dielectric fluid to the top end of said ducts, said distributing means disposed adjacent said top end of said winding and in fluid flow communication with said supplying means, said distributing means including a first member having a plurality of spacers attached to one surface thereof, said first member disposed with said spacers in registry with said top end of said electrical winding and the other surface of said first member in registry with said first pressure ring such that a first passage is formed between said top end of said electrical winding and said first member and compressive force is maintained on said electrical winding, said distributing means including at least one conduit disposed in said first passage and having first and second ends with at least one of said ends disposed in fluid flow communication with said supplying means, said conduit being formed of electrical insulating material and having a plurality of longitudinal and circumferential spaced apertures therein, said conduit further having a predetermined configuration across said top end of said electrical winding in which said apertures are located adjacent said cooling ducts such that said dielectric fluid is uniformly distributed over said cooling ducts; said distributing means further including a second member having a plurality of spacers attached to one surface thereof, said second member disposed with said spacers in registry with said bottom end of said winding and the other surface of said second member in registry with said second pressure ring to form a second passage below said electrical winding.

2. The electrical inductive apparatus of claim 1 wherein the apertures disposed in the portion of the conduit that is farthest removed from the end of said conduit disposed in fluid flow communication with the supplying means are spaced closer together than the apertures adjacent the end of said conduit that is connected to said supplying means.

3. The electrical inductive apparatus of claim 1 wherein the apertures disposed in the portion of the conduit that is farthest removed from the end of said conduit disposed in fluid flow communication with the supplying means have a larger diameter than the apertures adjacent the end of said conduit that is connected to said supplying means.

4. The electrical inductive apparatus of claim 1 wherein the conduit is constructed of a flexible material.

5. The electrical inductive apparatus of claim 1 wherein the supplying means includes a pump disposed below the level of the dielectric fluid in the bottom portion of the housing and a fluid conductor disposed in fluid flow communication with said pump on one end and the distributing means on the other end.

* * * * *